United States Patent [19]

Spriggs

[11] Patent Number: 4,704,336

[45] Date of Patent: Nov. 3, 1987

[54] SOLID PARTICLE EROSION RESISTANT COATING UTILIZING TITANIUM CARBIDE

[75] Inventor: Donald R. Spriggs, Schenectady, N.Y.

[73] Assignee: General Electric Company, Schenectady, N.Y.

[21] Appl. No.: 836,279

[22] Filed: Mar. 5, 1986

Related U.S. Application Data

[60] Division of Ser. No. 698,943, Feb. 7, 1985, Pat. No. 4,615,734, which is a continuation-in-part of Ser. No. 588,407, Mar. 12, 1984, abandoned.

[51] Int. Cl.[4] ..... B22F 3/00

[52] U.S. Cl. ..... 428/552; 75/236; 75/241; 75/242; 419/14; 419/15; 419/17; 428/666

[58] Field of Search ..... 419/14, 15, 17; 75/236, 75/241, 242; 428/552, 666

[56] References Cited

U.S. PATENT DOCUMENTS

| | | | |
|---|---|---|---|
| 2,736,086 | 2/1956 | Raine | 419/17 |
| 2,752,666 | 7/1956 | Goetzel et al. | 419/17 |
| 2,828,226 | 3/1958 | Goetzel et al. | 419/17 |
| 3,628,921 | 12/1971 | Hill | 419/17 |
| 3,653,982 | 4/1972 | Prill | 419/17 |
| 3,715,792 | 2/1973 | Prill | 419/17 |
| 3,967,935 | 7/1976 | Frehn | 419/17 |
| 4,615,734 | 10/1986 | Spriggs | 75/237 |

*Primary Examiner*—Stephen J. Lechert, Jr.
*Attorney, Agent, or Firm*—Jerome C. Squillaro

[57] ABSTRACT

A solid particle erosion resistant coating includes angular titanium carbide particles uniformly dispersed through a high chromium iron matrix. In one form, the aggregate comprises, by weight, about 30–50% TiC, about 10–30% Cr, about 1.5–5% C and the balance essentially iron in the form of ferrite. The matrix also includes metallurgically identifiable amounts of high chromium content $M_7C_3$ carbides therethrough. The coating does not exhibit austenitic or martensitic structure therethrough. A powder alloy consolidated body also includes a surface adjacent region having a similar TiC and high chromium iron matrix. Further, a method for obtaining the coating includes heating above the austenitization temperature of the matrix alloy and below the melting temperature of iron, and cooling the aggregate so as to attain iron in the form of ferrite in the matrix.

19 Claims, 2 Drawing Figures

100 X

400 X

SOLID PARTICLE EROSION RESISTANT COATING UTILIZING TITANIUM CARBIDE

RELATED APPLICATION

This is a division of application Ser. No. 698,943, filed 2/7/1985, now U.S. Pat. No. 4,615,734, which is a continuation-in-part of copending application entitled, "An Element Resistant To Solid Particle Erosion Utilizing Titanium Carbide," filed Mar. 12, 1984, accorded Ser. No. 588,407, assigned to the instant assignee and now abandoned.

BACKGROUND OF THE INVENTION

This invention relates generally to a solid particle erosion resistant and oxidation resistant coating or a body being so resistant, wherein the coating or body utilizes titanium carbide particles and preferably angular titanium carbide particles, dispersed through a high chromium iron matrix material.

In steam turbine systems, steam can be contaminated by relatively small solid particles. It is believed that these solid particles are predominantly magnetite, $Fe_3O_4$, and the particles may be referred to as "boiler scale" by persons of ordinary skill in the art. The solid particles are thought to originate in steam boiler tubing and adjoining pipes. During startup and normal operation of a steam turbine, these solid particles are carried through the entire steam turbine system by the steam flow. In this sense, the steam is called "contaminated" herein. Components within the steam flow path of the system are thus subject to solid particle erosion from solid particles impinging thereon, the extent of erosion depending in part upon velocity of the particles, steam pressure and temperature, and orientation of the component within the steam flow path, e.g. surface area of component normal to steam flow and angle at which particles impact the surface of the component.

Generally, turbine blades, which rotate within the steam turbine at high velocities, are especially subject to solid particle erosion, as are nozzle partitions, diaphragms, and areas within steam control valves. Valve stems and valve skirts are directly in the steam flow path and are greatly affected by solid particle erosion due in part to the sonic velocity which may be attained by steam passing through the valve during valving or throttling operations. Solid particle erosion may affect the useful life of steam turbine components. For example, some valves may have to be replaced or refurbished after an operating life much shorter than would be expected if the valve were operating in an environment free from solid particle erosion.

Titanium carbide has been well recognized in the metallurgical field as being very hard and resistant to many types of wear. Titanium carbide has been used with a steel matrix to provide a tool steel coating. The steel in the matrix of such a coating invariably has a martensitic metallurgical structure and can be applied, for example, by plasma spraying a relatively thin layer over the metal substrate. U.S. Pat. Nos. 3,896,244 - Ellis et al., and 3,886,637 - Ellis et al., disclose titanium carbide tool steel coatings. A processing technique disclosed by the '637 patent pre-alloys the coating material before spraying to ensure the presence of rounded grains of primary titanium carbide dispersed through a martensitic-containing steel matrix.

A coating or weldment including titanium carbide particles dispersed through a high chromium alloy matrix and deposited by plasma transferred arc application is disclosed by a brochure for TiCoat TM T-92 by Metallurgical Industries Inc., of Tinton Falls, New Jersey. The TiCoat TM T-92 coating is stated to be able to be deposited up to a thickness of ⅛" in a single pass and is recommended for use as a steel liner resistant to erosive wear by chilled cast iron grit utilized in a grit blasting operation. Another brochure by Metallurgical Industries on TiCoat TM T-93 states that the titanium carbide coating or weldment is applied by plasma transferred arc weld surfacing up to a thickness of 3/16" in a single pass. For multi-pass welding operations, titanium carbide will float or migrate to the upper surface of the previously deposited weldment, thereby resulting in a surface to which it is difficult to adhere another weld deposit and a loss in the uniformity of dispersion of titanium carbide throughout the coating. Attempts to increase the wettability of the previously deposited weldment include adding silicon and/or manganese. However, these additives promote the attainment of undesirable structures in the deposit, such as austenite, pearlite and sphereoidite.

Use of titanium carbide coatings disclosed by the prior art as an erosion resistant layer for steam turbine components, particularly valve components, is not acceptable in part due to demonstrated depth-of-coating limitations. Additionally, it is believed that a factor in determining the degree of erosion resistance of a titanium carbide layer is uniformity of dispersion of titanium carbide in a hard, erosion resistant matrix. It is also recognized in the art that because titanium carbide has a very low density with respect to typically employed matrix materials such as iron, nickel and cobalt, the carbide tends to float to the surface of a molten deposit such as is present in welding operations, thus destroying homogeneity and uniform carbide dispersion of the coating. Additionally, metallurgical analysis has shown that the matrix material that bonds titanium carbides together may erode preferentially with respect to the carbide particles, i.e. matrix material erodes before titanium carbide. Thus, solid particle erosion resistance of a coating including titanium carbide depends upon the process utilized to form the coating composite and to adhere titanium carbide particles and matrix material to the metal substrate, as well as the innate erosion resistance of the matrix which bonds the titanium carbide particles together and to the substrate. Of course, the deposition or consolidation process directly affects the degree of dispersement uniformity of titanium carbide in the coating. If the titanium carbide of the coating has been melted in the deposition process, it will be in the form of rounded grains and will also have a high likelihood of rising to the top of the deposit due to its reduced density. If the process of deposition or consolidation takes place in the solid state the carbide dispersion will be uniform and angularity or sharpness of the carbide particles will be retained.

Sintered powder metal products having titanium carbide additives are disclosed in U.S. Pat. No. 4,194,910—Mal. This patent discloses titanium carbide particles which are pre-alloyed by liquid phase sintering with iron and nickel base metals, and the resulting alloy is then dispersed through a base matrix, such as a steel matrix, wherein the matrix contains by weight 10% Cr, 2.9% Mo, 0.85% C and the balance essentially iron. Another U.S. Pat. No. 3,715,792—Prill et al., discloses a powder metallurgy sintered, allegedly wear resistant alloy having 45% TiC by volume in a high chromium alloy matrix. One of the disclosed matrices contains by weight 20% Cr, 0.8% C and the balance iron. In a specific example utilizing this composition, an alloy is produced which is annealed to generate a microstructure containing sphereoidite, and the alloy is thereafter hardened by heating to form a martensitic matrix. Other disclosures are to the effect that various titanium carbide alloys in hardened matrices resist erosion such as may be experienced in jet engine fuel pumps and valve seats. However, those disclosures do not specifically teach the chemical composition of the matrices or composition of the alloy, nor do they detail processing of the alloy and resulting metallurgical crystallographic structure of the alloy.

Accordingly, it is an object of the present invention to provide a solid particle erosion resistant coating or layer for steam turbine components.

It is another object of the present invention to provide a solid particle erosion resistant component body in the steam flow path of a steam turbine.

It is a further object of the present invention to provide a thicker solid particle erosion resistant coating comprising a more uniform dispersion of angular titanium carbide in a matrix alloy than is available using teachings of the prior art.

It is yet another object of the present invention to provide a method for applying to a substrate a solid particle erosion resistant coating using angular titanium carbide.

It is still another object of the present invention to provide a solid particle erosion and oxidation resistant coating containing titanium carbide and a matrix that itself is resistant to oxidation and erosion.

It is another object of the present invention to provide a method for applying to a substrate a solid particle erosion resistant coating wherein deposition and consolidation of the coating takes place in the solid state.

SUMMARY OF THE INVENTION

In accordance with the present invention, a solid particle erosion resistant element, having a surface adjacent region exposed to solid particle erosion by contaminated steam, includes a titanium carbide coating covering the exposed region. The titanium carbide coating contains by weight about 30 to 50% angular titanium carbide particles dispersed relatively uniformly through a high chromium iron matrix. The coating or layer is a substantially homogeneous aggregate and does not substantially exhibit austenitic or martensitic crystallography therethrough. The matrix may comprise by weight about 10 to 30% chromium, about 1.5 to 5% carbon, and the balance essentially iron. The iron constituent of this matrix is crystallographically identifiable as alpha-iron (i.e. body centered cubic). The coating also may include metallurgically identifiable amounts of high chromium content $M_7C_3$ carbides therethrough, wherein M represents the total of iron and chromium atoms which are bonded to carbon in the ratio of 7:3.

Another embodiment of the present invention includes a powder alloy consolidated body having a surface adjacent region exposed to solid particle erosion by contaminated steam flowing through the steam turbine system. The composition of the surface adjacent region of the body is essentially similar to that of the titanium carbide coating.

A method for producing a solid particle erosion and oxidation resistant material comprises consolidating angular titanium carbide and a matrix alloy, wherein the alloy includes about 10% to about 30% by weight chromium, about 1.5% to about 5% by weight carbon and the balance essentially iron, at a temperature above the austenitization temperature of the matrix alloy and below the melting temperature of iron in an inert atmosphere at a pressure of about 10 to about 20 ksi, and cooling the resulting consolidated titanium carbide and matrix alloy at a rate such that the iron will attain a ferrite crystallographic phase.

BRIEF DESCRIPTION OF THE DRAWING

The subject matter which is regarded as the invention is particularly pointed out and distinctly claimed in the concluding portion of the specification. The invention, however, together with further objects and advantages thereof, may best be understood by reference to the following description taken in connection with the accompanying drawing, in which:

DETAILED DESCRIPTION

The present invention relates generally to a titanium carbide composition which is resistant to solid particle erosion such as may be experienced by steam turbine components disposed in the steam flow path of a steam turbine. In one embodiment of the present invention, those components include a metal substrate having a surface adjacent region exposed to solid particle erosion by contaminated steam flowing through the turbine system. The exposed region of the substrate includes a titanium carbide coating thereon. As used herein, the term "coating" is synonomous with the term "layer". The coating contains by weight about 30% to about 50%, preferably about 35% to about 45%, angular titanium carbide particles, which are essentially pure and not alloyed with any other material, uniformly dispersed through a high chromium iron matrix.

Not all titanium carbide is angular. Angular titanium carbide is usually formed by mechanically crushing bulk titanium carbide in order to fracture the crystalline structure. The crushed titanium carbide is screened to select the desired size and may be further crushed to provide an adequate quantity of the desired size. For angular titanium carbide, the edges and faces thereof are not rounded. Existence of angular titanium carbide in the coating or post-processing composite of the present invention verifies that the angular titanium carbide has not been melted (melting angular titanium carbide causes the edges and faces thereof to become rounded) during processing of angular titanium carbide powder and matrix alloy powder in accordance with the present invention. It is important that the angular titanium carbide not melt, since if it does melt then it will float or migrate as hereinbefore explained.

The high chromium iron matrix comprises by weight about 10 to 30%, preferably about 25 to 30% chromium, about 1.5% to about 5%, preferably about 2.8% to about 3.2%, carbon and the balance essentially iron. The matrix may also include nominal amounts of up to about 2% each molybdenum and tungsten as well as up to about 1% by weight of other trace elements, such as nickel and cobalt, well known to those of ordinary skill in the art.

The amounts of carbon and chromium are important to the composition of the matrix. If the carbon content is too low, the desired number of secondary carbides, i.e. $M_7C_3$, which assist in providing erosion resistance, will not be formed, and if the carbon content is too high, graphite, which is too soft to be effective for providing erosion resistance, may be formed. If the chromium content is too low, resistance to oxidation and erosion resistance of the matrix may be reduced, while if the chromium content is too high, brittle phases, such as free chromium, may be formed.

Figure 1:
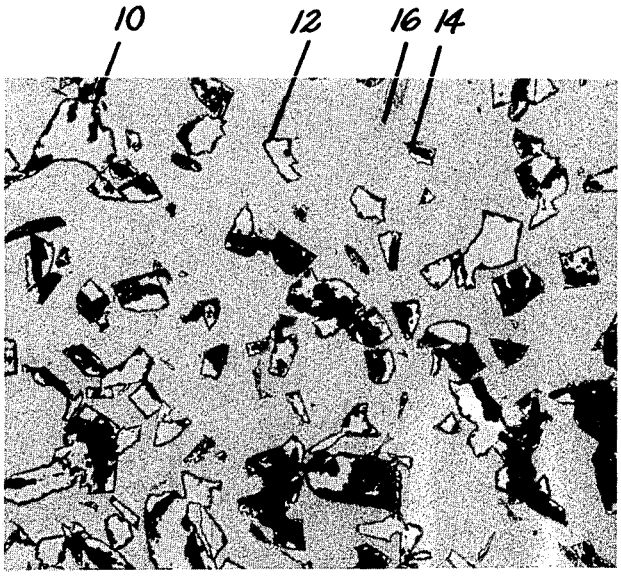
FIG. 1 is a cross sectional photomicrograph, magnified 100×, of one embodiment of a titanium carbide composition of the present invention.

FIG. 1 is a photomicrograph at a magnification of 100× showing a titanium carbide coating comprising a substantially homogeneous aggregate in accordance with the present invention. Angular titanium carbide particles 10, 12 and 14 are shown as being of various sizes and shapes. A high chromium iron matrix, generally designated by reference numeral 16, bonds titanium carbide particles 10, 12 and 14 together, as well as bonds the aggregate to the metal substrate (not shown) of the component to be coated. Preferably, the titanium carbide coating covers the exposed region of the component to a depth of at least 0.25". Significantly greater depths are possible due to the coating process of the present invention (described in detail below), which does not cause the starting angular titanium carbide to melt in order to fabricate a coating.

Figure 2:
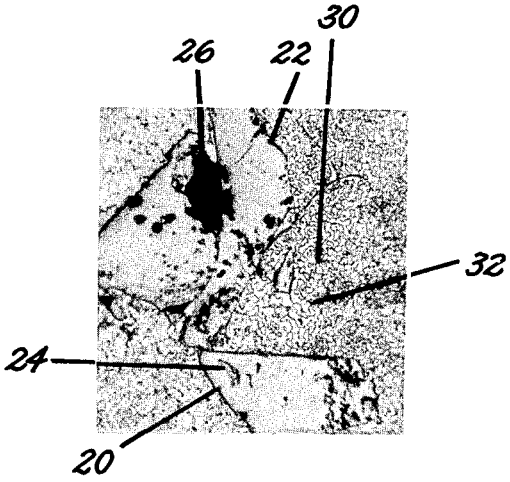
FIG. 2 is a cross sectional photomicrograph, magnified 400×, of the titantium carbide composition of FIG. 1.

FIG. 2 is a photomicrograph of the titanium carbide composition of FIG. 1 at a magnification of 400×. Angular titanium carbide particles 20 and 22 are disposed in high chromium iron matrix 16. Particle 20 is believed to include a metallurgical contaminant noted by reference numeral 24. Reference numeral 26 designates a pore or void in one titanium carbide island such as may result from gas or other porosity in the starting titanium carbide material, oxide contamination (may be avoided by using a purer starting titanium carbide material) or locally incomplete closure of the powder alloy consolidation about this particular titanium carbide island. Reference numeral 30 designates a metallurgically identifiable high chromium content $M_7C_3$ carbide. The $M_7C_3$ carbide represents a family of carbide compositions. Specifically, the $M_7C_3$ carbide may be selected from the group consisting of $Cr_7C_3$, $Cr_4Fe_3C_3$, $Cr_5Fe_2C_3$ and $Cr_1(A)_6C_3$, wherein A is selected from the group consisting of iron, nickel, cobalt, tungsten and molybdenum, and may include trace amounts of other elements, such as nickel and cobalt, known to those of ordinary skill in the art. Another formulation of the $M_7C_3$ carbide is $Cr_xA_yC_3$ wherein $x+y=7$ and A is as described in the preceeding sentence. Ferrite, or alpha-Fe, is designated by reference numeral 32 in FIG. 2.

In accordance with the present invention, a process to obtain a titanium carbide coating, preferably of at least a depth of 0.25" (although thinner coatings are possible), preferably includes powder alloy consolidation. One form of consolidation is hot isostatic pressing of the powder alloy. The titanium carbide rich product shown in FIG. 1 and 2 was produced by powder alloy consolidation. The preferred range of angular titanium carbide particles in the resulting composition is 35 to 45% by weight. If the titanium carbide particles exceed 50% by weight, experiments have shown that the resulting composition is too brittle to be handled, machined and utilized as a component in a steam turbine environment. Also, it may be possible to apply the blended or pre-alloyed powder by plasma spraying to form the coating and subsequent heat treatment to generate the $M_7C_3$ precipitate in alpha-Fe (i.e. austenitize and then use controlled rate of cool-down as described below). Careful control of the plasma spray process parameters is necessary to assure a uniform dispersion while minimizing melting of titanium carbide.

Powder alloy consolidation sinters the powder together. Careful initial powder blending to obtain a uniform dispersion of titanium carbide powder throughout the matrix material powder and a controlled rate of cool-down from the consolidation temperature assures that the resulting aggregate is substantially homogeneous and ferritic, and does not exhibit austenitic or martensitic crystallography therethrough. This distinction over known coatings and weld deposits is important because it is believed the ferritic matrix, and especially the fine $M_7C_3$ high chromium carbide precipitates, significantly contribute to solid particle erosion and oxidation resistance characteristics of the composition as a whole. The titanium carbide and matrix material powder could be powder alloy consolidated directly onto a metal substrate, or the starting blended powder could be consolidated and thereafter machined into a desired form, such as a steam turbine component.

In a method for coating according to the present invention, high chromium iron matrix material in accordance with the previously described composition is pre-alloyed and available in the form of about −100 mesh, preferably −140 mesh +10 micron, powder and angular titanium carbide available in the form of about −100 mesh, preferably −140 mesh +10 micron, powder are mechanically blended to form a substantially homogeneous powder blend. It is not necessary that the matrix material powder and titanium carbide powder be the same size, and in fact, it may be desirable to have the titanium carbide powder larger than the matrix material powder within the above noted sizes. The blended powder is consolidated by hot isostatic pressing onto the substrate to be protected at a temperature, i.e. the consolidation temperature, which is well above austenitization temperature of the matrix alloy (i.e. above about 2000° F.) and below the melting temperature of iron, preferably from about 2150° F. to about 2250° F., and more preferably at about 2200° F., in an inert atmosphere, such as argon or helium, at a pressure of about 10 to 20 ksi (thousands of pounds per square inch) preferably about 15 ksi, for a period of about 3 to 6 hours, preferably about 4 hours. That is, the homogeneous powder is simultaneously heated and pressed. Full coating density and bonding to the substrate is experienced. Significantly, the entire consolidation and bonding process takes place in the solid state. That is, there is no melting of the components of the blended powder and therefore no inducement for angular titanium carbide to float or migrate. In addition, the matrix constituent is fully austenitized above a temperature of about 2000° F.

The substrate, having the consolidated coating applied thereto, is slowly cooled to room temperature at a rate not greater than the rate at which the matrix iron will attain a ferrite final configuration, preferably not greater than about 8° C. per minute and more preferably about 5° C. per minute. During cooling, the high chromium iron matrix constituents form a fine, uniform dispersion of matrix or secondary carbides rich in chromium and iron. These matrix carbides are crystallographically identifiable as $M_7C_3$, wherein M represents the total of iron and chromium atoms which are bonded to carbon in the ratio of 7:3, i.e. $(Cr,Fe)_7C_3$. The desired composition of the matrix carbide may be assured by controlling the ratio of chromium to carbon in the high chromium iron from about 4:1 to about 10:1, preferably about 8:1, weight fraction chromium to carbon. It is desirable not to operate outside these limits since if the ratio of chromium to carbon is higher or lower carbides other than $M_7C_3$ carbides as well as other less desirable metallurgical phases may be generated.

An important consequence of the formation of the desired matrix carbides, combined with the prescribed cooling rate from the consolidation temperature, is that the metallurgical phase of iron remaining in the matrix alloy (after formation of $M_7C_3$ matrix carbides) is alpha-iron (equivalently ferrite, or iron with a body-centered cubic crystal structure). Therefore the formation of martensite and austenite is effectively precluded and the resulting composition requires no tempering treatment to relieve stress or enhance stability. The high chromium iron matrix of the present invention thus comprises two phases, ferritic iron and relatively small, fine $M_7C_3$ matrix carbides uniformly dispersed therethrough. The larger, angular titanium carbide particles are uniformly dispersed through and supported by the high chromium iron matrix.

The composite coating has demonstrated excellent resistance to oxidation and solid particle erosion in laboratory tests which simulate a high temperature contaminated turbine flow path. The ferritic matrix renders the coating of the present invention more compatible with ferritic substrates than would a non-ferritic matrix. That is, coating and substrate compositional stability and thermal expansion compatability are improved. This is especially beneficial for coating steam turbine components, many of which are typically ferritic as the primary metallic constituent.

It is believed that uniform dispersion of angular titanium carbide particles throughout the coating or the powder metal consolidated body must be achieved to provide a steam turbine component with desirable solid particle erosion and oxidation resistant characteristics. Further, wetting agents such as silicon and manganese are not required in order to prepare an existing layer to receive an additional layer of coating material in accordance with the present invention. In addition, since melting of angular titanium carbide, with attendant floating and wetting problems previously described, does not occur during processing in accordance with the present invention, applicant has not experienced, nor would be expected to experience, any limitation with respect to the thickness obtainable with the present coating.

In another aspect of the present invention, the material forming the coating may also be fabricated so as to constitute a component. Fabrication may include shaping the material using a mold or generating bulk material and then working the bulk material, such as by machining, to the desired shape. A mandrel for providing an initial starting shape may also be used. Further, processing angular titanium carbide and high chromium iron matrix material according to the present invention results in a non-brittle engineering material which may be machined without breaking, may be repaired, and, in general, favorably responds to metal working processes.

Thus has been illustrated and described a solid particle erosion resistant coating and method for application thereof using angular titanium carbide which is substantially uniformly dispersed through a matrix that is itself resistant to oxidation and erosion, wherein deposition and consolidation of the coating occurs in the solid state. Further, a component coated therewith for use in a steam turbine has been described. Further, the thickness of the coating may be greater than coatings using the teachings of the prior art. In addition, iron of the high chromium iron matrix is processed to attain a ferritic form which does not exhibit martensitic or austenitic crystallographic structures and secondary carbides are formed throughout the matrix.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. As an article of manufacture, a solid particle erosion resistant component for use in a steam turbine system comprising:

a metal substrate having a surface adjacent region subject to solid particle erosion when exposed to contaminated steam flowing through said steam turbine system; and a coating disposed on the surface adjacent region of said substrate, said coating including by weight about 30% to about 50% angular titanium carbide particles dispersed through a high chromium iron matrix, said coating being a substantially homogeneous aggregate which does not substantially exhibit austenitic or martensitic crystallography therethrough.

2. The article of manufacture as in claim 1, wherein said coating covers said surface adjacent region to a depth of at least 0.25 inches.

3. The article of manufacture as in claim 1 wherein said high chromium iron matrix comprises by weight about 10% to about 30% chromium, about 1.5% to about 5% carbon and the balance essentially iron.

4. The article of manufacture as in claim 3, wherein the weight fraction of chromium to carbon in the matrix is from about 4:1 to about 10:1.

5. The article of manufacture as in claim 4, wherein the weight fraction of chromium to carbon in the matrix is about 8:1.

6. The article of manufacture as in claim 3, wherein said high chromium iron matrix further comprises by weight about 25% to about 30% chromium and about 2.8% to about 3.2% carbon and the balance essentially iron.

7. The article of manufacture as in claim 3, wherein said coating further includes by weight about 35% to about 45% angular titanium carbide.

8. The article of manufacture as in claim 3, wherein said high chromium iron matrix further includes by weight up to about 2% each molybdenum and tungsten.

9. The article of manufacture as in claim 3, wherein said matrix includes metallurgically identifiable amounts of high chromium content $M_7C_3$ carbides, wherein M represents the total of iron and chromium atoms which are bonded to carbon in the ratio of 7:3.

10. The article of manufacture as in claim 1, wherein said titanium carbide particles are substantially uniformly dispersed through said matrix.

11. As an article of manufacture, a solid particle erosion resistant component for use in a steam turbine system comprising a powder metal consolidated body having a surface adjacent region subject to solid particle erosion when exposed to contaminated steam flowing through said steam turbine system, said surface adjacent region of said body including by weight about 30% to about 50% angular titanium carbide particles dispersed through a high chromium iron matrix, said body being a substantially homogeneous aggregate which does not substantially exhibit austenitic or martensitic crystallography therethrough.

12. The article of manufacture as in claim 11, wherein said high chromium iron matrix comprises by weight about 10% to about 30% chromium, about 1.5 to about 5% carbon and the balance essentially iron.

13. The article of manufacture as in claim 12, wherein said high chromium iron matrix further comprises by weight about 25% to about 30% chromium, about 2.8% to about 3.2% carbon and the balance essentially iron.

14. The article of manufacture as in claim 12, wheein said coating further includes by weight about 35% to about 45% angular titanium carbide.

15. The article of manufacture as in claim 12, wherein the weight fraction of chromium to carbon in the matrix is from about 4:1 to about 10:1.

16. The article of manufacture as in claim 15, wherein the weight fraction of chromium to carbon in the matrix is about 8:1.

17. The article of manufacture as in claim 12, wherein said high chromium iron matrix further includes by weight up to 2% each molybdenum and tunsten.

18. The article of manufacture as in claim 12, wherein said matrix includes metallurgically identifiable amounts of high chromium content $M_7C_3$ carbides, wherein M represents the total of iron and chromium atoms which are bonded to carbon in the ratio of 7:3.

19. The article of manufacture as in claim 11, wherein said titanium carbide particles are substantially uniformly dispersed through said matrix.

* * * * *